US010113292B2

(12) United States Patent
Yokota et al.

(10) Patent No.: US 10,113,292 B2
(45) Date of Patent: Oct. 30, 2018

(54) QUICK COUPLER CONTROL DEVICE FOR WORKING MACHINE

(71) Applicant: Caterpillar SARL, Geneva (CH)

(72) Inventors: Kenichi Yokota, Tokyo (JP); Shigeru Abe, Tokyo (JP); Yuya Kanenawa, Tokyo (JP); Yujiro Yukimura, Tokyo (JP)

(73) Assignee: Caterpillar SARL, Geneva (CH)

( * ) Notice: Subject to any disclaimer, the term of this patent is extended or adjusted under 35 U.S.C. 154(b) by 81 days.

(21) Appl. No.: 15/302,799

(22) PCT Filed: Apr. 8, 2015

(86) PCT No.: PCT/EP2015/057607
§ 371 (c)(1),
(2) Date: Oct. 7, 2016

(87) PCT Pub. No.: WO2015/155232
PCT Pub. Date: Oct. 15, 2015

(65) Prior Publication Data

US 2017/0030047 A1 Feb. 2, 2017

(30) Foreign Application Priority Data

Apr. 8, 2014 (JP) ..... 2014-079390

(51) Int. Cl.
*E02F 3/36* (2006.01)
*E02F 9/22* (2006.01)
(Continued)

(52) U.S. Cl.
CPC ..... *E02F 3/3663* (2013.01); *E02F 3/32* (2013.01); *E02F 3/3618* (2013.01);
(Continued)

(58) Field of Classification Search
CPC ..... E02F 3/3618; E02F 3/3663; E02F 3/3668; E02F 3/3672; E02F 3/3609
See application file for complete search history.

(56) References Cited

U.S. PATENT DOCUMENTS 5,147,173 A * 9/1992 Fauber ..... E02F 3/3663 414/723
7,367,256 B2 5/2008 Fatemi et al.
(Continued)

FOREIGN PATENT DOCUMENTS

JP 2008-266975 A 11/2008
WO WO 2012/122469 A1 9/2012

OTHER PUBLICATIONS

European Patent Office, International Search Report in International Patent Application No. PCT/EP2015/057607, dated Jul. 7, 2015, 2 pp.

*Primary Examiner* — Gerald McClain

(57) ABSTRACT

In a control device, a pilot-operated first check valve connects a solenoid-operated first directional control valve to a lock side chamber of a lock cylinder installed in a quick coupler. A pilot-operated second check valve is connected to the lock cylinder unlock side chamber, a solenoid-operated second directional control valve connected between the second check valve and the first directional control valve. The first and second directional control valves are controlled by a controller with processed signals input from a mode selector switch, first sensor detecting a buck closing pilot pressure, and second sensor detecting a bucket closing working pressure.

3 Claims, 6 Drawing Sheets

(51) Int. Cl.
*E02F 3/32* (2006.01)
*E02F 9/20* (2006.01)

(52) U.S. Cl.
CPC ..... *E02F 3/3622* (2013.01); *E02F 9/226* (2013.01); *E02F 9/2004* (2013.01)

(56) References Cited

U.S. PATENT DOCUMENTS

| | | | | |
|---|---|---|---|---|
| 9,834,904 | B2 * | 12/2017 | Friedrich | E02F 3/3663 |
| 2011/0286788 | A1 * | 11/2011 | Sikorski | E02F 3/3663<br>403/315 |
| 2015/0330053 | A1 * | 11/2015 | Ravindran | E02F 3/3663<br>29/426.5 |
| 2016/0326712 | A1 * | 11/2016 | Koestler | E02F 3/3663 |

* cited by examiner

QUICK COUPLER CONTROL DEVICE FOR WORKING MACHINE

CROSS-REFERENCE TO RELATED APPLICATIONS

This application is a national phase application of International Patent Application No. PCT/EP2015/057607, filed Apr. 8, 2015, which claims priority to Japanese Patent Application No. JP 2014-079390, filed Apr. 8, 2014, both of which are incorporated by reference herein in their entireties for all purposes.

TECHNICAL FIELD

The present invention relates to a quick coupler control device for a working machine.

BACKGROUND ART

As depicted in FIG. 5, in an excavator 11, a bucket 14 serving as a work tool is removably attached by means of a hydraulic quick coupler (hereinafter simply referred to as a "quick coupler") 15, to a tip portion of a working apparatus 13 mounted on a machine body 12.

In the working apparatus 13, an arm 17 pivoted by an arm cylinder 17CY is pivotally supported at a tip of a boom 16 pivoted by a boom cylinder 16CY. A bucket cylinder 14CY serving as a tool cylinder and the quick coupler 15, pivoted by a link plate 18, are attached to a tip of the arm 17.

FIG. 6 depicts an example of the quick coupler 15. A fixing engagement portion 22 with a recess groove is integrally provided on a coupler main body 21 coupled to the tip of the arm 17 and the link plate 18. A base end of a lock cylinder 15CY is provided in the coupler main body 21 so as to be able to pivot via a shaft 23. A movable engagement portion 24 coupled via a shaft to a tip of a piston rod of the lock cylinder 15CY is freely pivotally attached to the coupler main body 21 via a shaft 25. The lock cylinder 15CY performs an extending operation to lock a state of tool coupling and performs a contracting operation to cancel the state of tool coupling and establish an unlock state (for example, see Patent Literature 1).

In the quick coupler 15, as depicted in FIGS. 7(*i*) and 7(*ii*), the fixing engagement portion 22 of the quick coupler 15 is internally engaged with a pin 22*p*, one of a pair of pins 22*p* and 24*p* provided on a bracket of the bucket 14 positioned on the ground. Moreover, as depicted in FIGS. 7(*ii*) and 7(*iii*), the bucket cylinder 14CY is allowed to perform an extending operation to pivot the quick coupler 15 clockwise around the pin 22*p* to interpose the movable engagement portion 24 inside the other pin 24*p*. Then, the lock cylinder 15CY performs an extending operation to engage the movable engagement portion 24 with a lower side of the pin 24*p* thereby locking the state of tool coupling.

FIG. 8 depicts a hydraulic circuit in the lock cylinder 15CY. Pressure oil pressurized by a main pump 27 driven by an in-vehicle engine is directionally controlled by a bucket cylinder control valve 14CV and thus fed to a head side of the bucket cylinder 14CY. Furthermore, the pressure oil is directionally controlled by a solenoid operated control valve 15ES and thus fed to a head side or a rod side of the lock cylinder 15CY.

That is, in an unexcited state, the solenoid operated control valve 15ES feeds pressure oil to the head side of the lock cylinder 15CY to allow the lock cylinder 15CY to perform a lock operation. Furthermore, in an excited state, the solenoid operated control valve 15ES feeds pressure oil to the rod side of the lock cylinder 15CY to allow the lock cylinder 15CY to perform an unlock operation. A pilot operated check valve 15CV is provided in a head side circuit in the lock cylinder 15CY, at the time of an unlock operation in which the solenoid operated control valve 15ES is switched from the unexcited state to the excited state, hydraulic pressure is supplied to the rod side of the lock cylinder 15CY to subject the pilot operated check valve 15CV to a pilot operation to cancel a check function of the pilot operated check valve 15CV (for example, see Patent Literature 2).

A bucket cylinder control valve 14CV is a pilot operated check valve. A pilot operation is performed on the bucket cylinder control valve 14CV by reducing a pilot primary pressure supplied by a pilot pump 28 driven along with a main pump 27 by the in-vehicle engine, to a pilot secondary pressure using a pilot operation valve 14PV, what is called a remote control valve, in accordance with the amount of operation of an operation lever 14L of the pilot operation valve 14PV. Thus, the bucket cylinder 14CY is extended, contracted, or stopped. Reference numeral 29 denotes an oil tank shared by both pumps.

To allow the quick coupler 15 to perform a coupling operation, pressure oil is fed to the head side of the bucket cylinder 14CY via the bucket cylinder control valve 14CV. First, the unloaded bucket cylinder 14CY is actuated in an extending direction to impose a load on the bucket cylinder 14CY. Then, the pressure oil is fed to the head side of the lock cylinder 15CY through the solenoid operated control valve 15ES and pilot operated check valve 15CV in the unexcited state as depicted in FIG. 8. The lock cylinder 15CY performs an extending operation to allow the movable engagement portion 24 to perform a lock operation.

On the other hand, to uncouple the quick coupler 15, the solenoid operated control valve 15ES is set to an excited state and switched to the opposite side. Then, the pressure oil is fed to the rod side of the lock cylinder 15CY to cancel a check function of the pilot operated check valve 15CV, while operating the lock cylinder 15CY in an unlock direction. Thus, the movable engagement portion 24 can be removed from the other pin 24*p*. Subsequently, the bucket cylinder control valve 14CV is switched via the pilot operated check valve 14PV to operate the quick coupler 15 as depicted in FIG. 7(*iii*), FIG. 7(*ii*), and FIG. 7(*i*) in this order. Thus, the quick coupler 15 is removed from the bucket 14.

[Patent Literature 1] Japanese Patent Application Laid-open No. 2008-266975

[Patent Literature 2] U.S. Pat. No. 7,367,256 (Specification)

The conventional circuit depicted in FIG. 8 fails to stop the lock cylinder 15CY of the quick coupler while the lock cylinder 15CY is being actuated. Even if an expensive selector valve is provided which enables the stoppage of the supply of pressure oil to the head side of the lock cylinder 15CY, the pressure contained in a head-side chamber becomes higher than the pressure on the rod side that communicates with a tank. Thus, the rod of the lock cylinder 15CY extends and causes malfunction, inducing a lock state. Consequently, the movable engagement portion 24 is caught on the pin 24*p*. The amount of the extension is not large, but the movement is against an operator's intention and leads to unexpected catching of the movable engagement portion 24. In the worst case, the bucket 14 may fail to come off.

With the foregoing in view, it is an object of the present invention to provide a quick coupler control device of a working machine which allows a lock cylinder to be constantly pressurized into a lock state except when a work tool is replaced and which allows the lock cylinder to be prevented from malfunctioning to cause a lock state when the work tool is replaced.

DISCLOSURE OF THE INVENTION

An invention set forth in claim 1 is a quick coupler control device for a working machine comprising: a quick coupler that allows a work tool to be removably installed on a working arm of the working machine; a lock cylinder attached to the quick coupler and having a lock-side chamber that is pressurized when the work tool installed on the quick coupler is actuated in a lock direction in which the work tool is fixed and an unlock-side chamber that is pressurized when the work tool is actuated in an unlock direction in which the work tool is unfixed; a solenoid-operated first direction control valve having an unexcited position where a working fluid fed under pressure from a fluid pressure source is guided to a lock-side chamber of the lock cylinder and an excited position where the working fluid fed under pressure from the fluid pressure source is guided to an unlock-side chamber of the lock cylinder and where a return fluid discharged from the lock-side chamber is discharged to a low pressure side of the fluid pressure source; a pilot-operated first check valve that sets a forward direction, in which a working fluid is fed under pressure from the first direction control valve to the lock-side chamber of the lock cylinder, a check function of the pilot-operated first check valve being cancelled by a working fluid fed under pressure to the unlock-side chamber of the lock cylinder; a pilot-operated second check valve that sets a forward direction, in which a working fluid is fed under pressure to the unlock-side chamber of the lock cylinder, a check function of the pilot-operated second check valve being cancelled by a working fluid fed under pressure to the lock-side chamber of the lock cylinder; and a solenoid-operated second direction control valve having an unexcited position where a return fluid flowing out from the unlock-side chamber of the lock cylinder via the second check valve is discharged to the low pressure side of the fluid pressure source and where a working fluid fed via the first direction control valve is blocked and an excited position where a working fluid fed via the first direction control valve is guided to the unlock-side chamber of the lock cylinder.

An invention set forth in claim 2 is the quick coupler control device for the working machine according to claim 1, further including a tool cylinder that pivots the work tool that is removably installed on the working arm of the working machine via the quick coupler; a mode selector switch that switches between a lock mode where the lock cylinder is actuated in the lock direction and an unlock mode where the lock cylinder is actuated in the unlock direction; a first sensor that detects whether a state of operation where the tool cylinder is actuated in a predetermined direction is established or a state of no operation where the tool cylinder is not actuated in the predetermined direction is established; a second sensor that detects whether a loaded state where load is applied to the tool cylinder is established or a unloaded state where load is not applied to the tool cylinder is established; and a controller having a function to control the first direction control valve and the second direction control valve to the unexcited position when the mode selector switch is in the lock mode and to control the first direction control valve and the second direction control valve to the excited position when the mode selector switch is in the unlock mode and the first sensor and the second sensor detect the operation state and the loaded state, respectively, and otherwise to control the first direction control valve and the second direction control valve to the excited position and the unexcited position, respectively.

An invention set forth in claim 3 is the quick coupler control device for the working machine according to claim 2, wherein the tool cylinder is a bucket cylinder that pivots a bucket serving as a work tool removably installed by means of the quick coupler on an arm of an excavator serving as a working machine, the first sensor is provided in a pilot pressure circuit that operates a bucket cylinder control valve in a bucket close direction, the bucket cylinder control valve controlling the bucket cylinder, the second sensor is provided in a working fluid pressure circuit that actuates the bucket cylinder in the bucket close direction, and the controller has a function to control the first direction control valve and the second direction control valve to the excited position when the mode selector switch is in the unlock mode and the first sensor and the second sensor detect the operation state in the bucket close direction and the loaded state in the bucket close direction, respectively, and otherwise to control the first direction control valve and the second direction control valve to the excited position and the unexcited position, respectively.

According to the invention set forth in claim 1, the pilot-operated first and second check valves are provided which have mutual check cancelling functions with respect to the lock cylinder, and the solenoid-operated first and second direction control valves are controlled to the excited position or to the unexcited position. Thus, using the simple improvement in which the second direction control valve and second check valve having existing inexpensive structures are added to the first check valve and first direction control valve used in conventional circuits, the lock cylinder can constantly be pressurized into a lock state, ensuring a coupled state of the quick coupler, except when the work tool is replaced. Furthermore, the lock cylinder can be prevented from malfunctioning to cause the lock state, allowing the quick coupler to be smoothly uncoupled, when the work tool is replaced.

According to the invention set forth in claim 2, the mode selector switch, the first sensor and second sensor for the tool cylinder, and the controller control the first direction control valve and second direction control valve for the lock cylinder to the excited position or to the unexcited position. Thus, when the work tool is replaced, the lock state of the quick coupler can be automatically cancelled after the first sensor and the second sensor detect that the work tool is placed in a predetermined orientation by being actuated in a predetermined direction. The quick coupler can be smoothly removed from the work tool in the predetermined orientation to reliably cancel the coupled state of the quick coupler. Furthermore, a tool pivoting operation and movement of the lock cylinder can be synchronized with each other so that stopping the tool pivoting operation allows the actuated lock cylinder to be stopped. This enables the quick coupler to be prevented from malfunctioning against the operator's intention.

According to the invention set forth in claim 3, the first sensor is provided in the pilot pressure circuit that operates the control valve for the bucket cylinder in the bucket close direction, the second sensor is provided in the working fluid pressure circuit that operates the bucket cylinder in the bucket close direction, and the controller controls the first direction control valve and the second direction control valve to the excited position when the mode selector switch is in the unlock mode and the first sensor and the second sensor detect the operation state in the bucket close direction and the loaded state in the bucket close direction, respectively, and otherwise controls the first direction control valve and the second direction control valve to the excited position and the unexcited position, respectively. Thus, when the bucket is replaced, the lock state of the quick coupler can be automatically cancelled after the first sensor and the second sensor detect that the bucket has been placed in a predetermined closed orientation by being actuated in the close direction. The quick coupler can be smoothly removed from the bucket in the predetermined closed orientation to reliably cancel the coupled state of the quick coupler. Furthermore, a bucket close operation and movement of the lock cylinder can be synchronized with each other so that stopping the bucket close operation allows the lock cylinder to be stopped. This enables the quick coupler to be prevented from malfunctioning against the operator's intention, and allows an operation of unlocking the quick coupler to be suspended as needed.

BEST MODE FOR CARRYING OUT THE INVENTION

Figure 5:
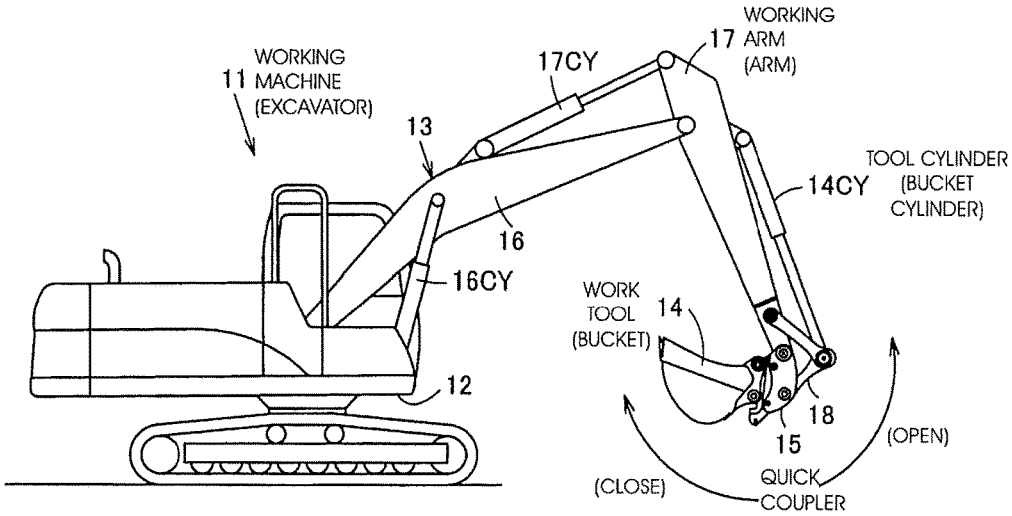
FIG. 5 is a side view of an excavator to which the control device is applied.
Figure 6:
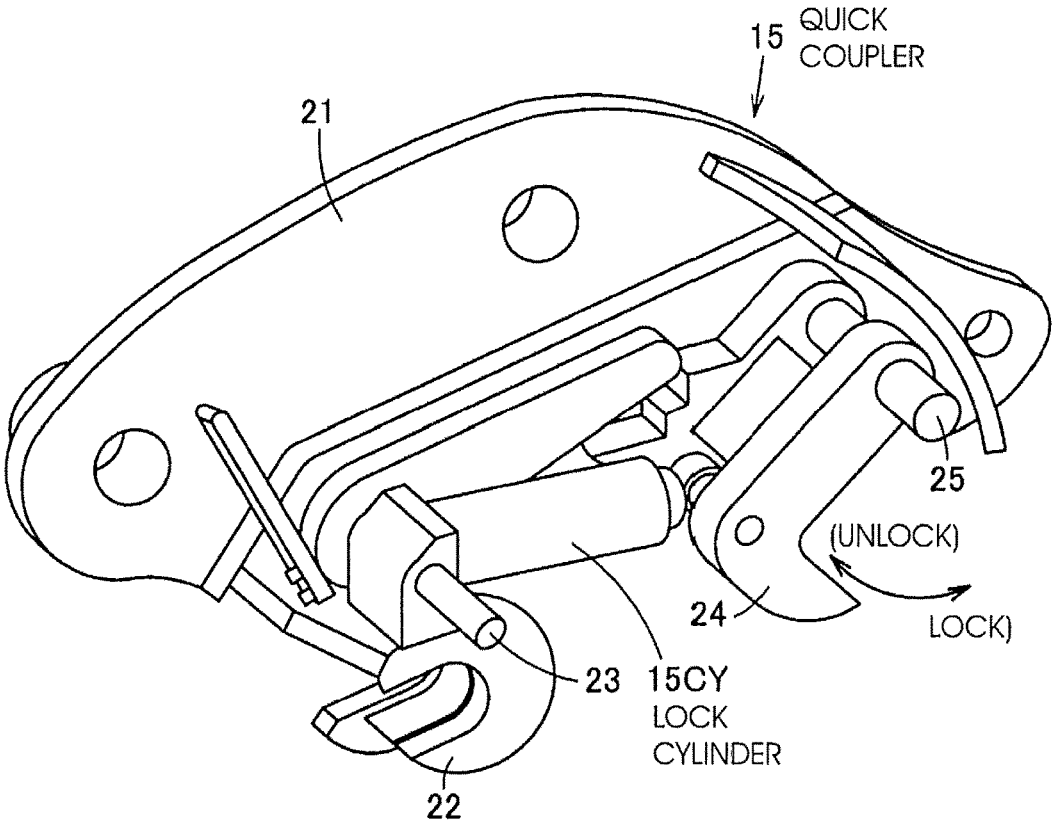
FIG. 6 is a perspective view depicting an internal structure of a quick coupler to which the control device is applied.
Figure 7:
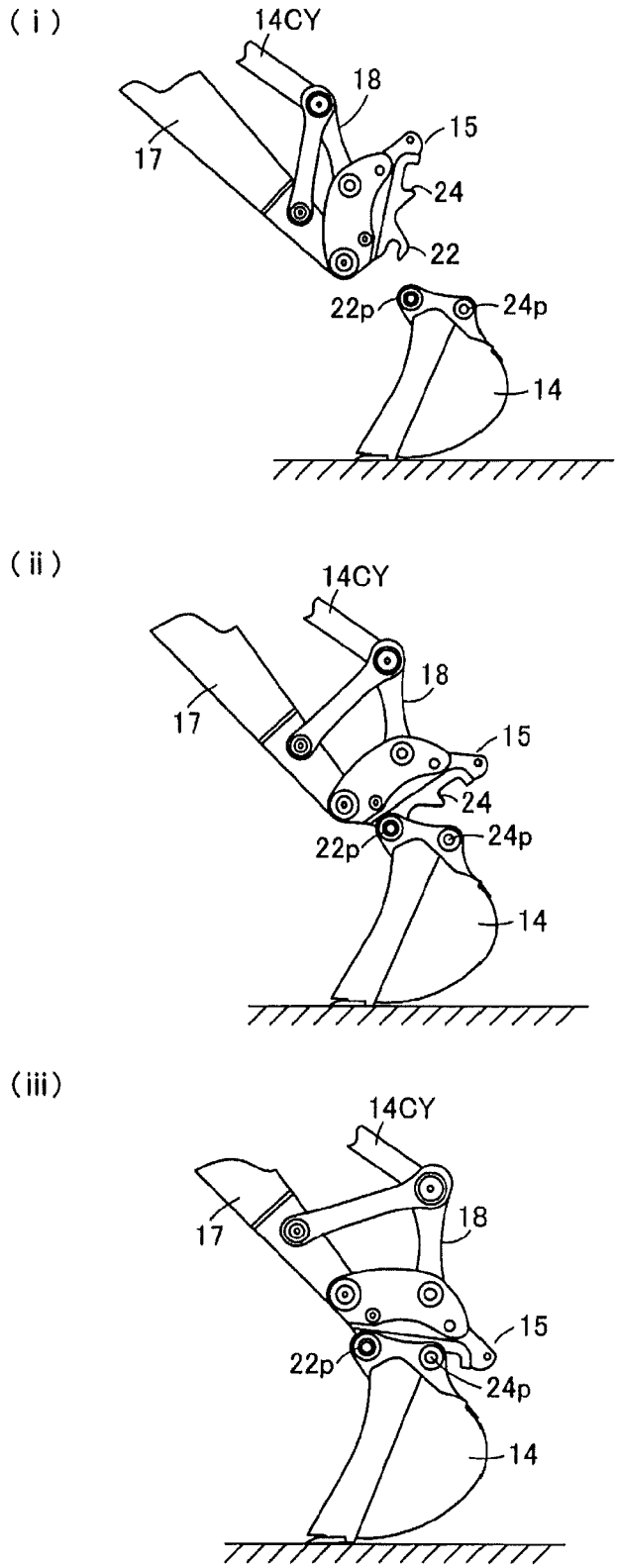
FIG. 7 is a side view depicting a change in orientation at the time of coupling of the quick coupler.
Figure 8:
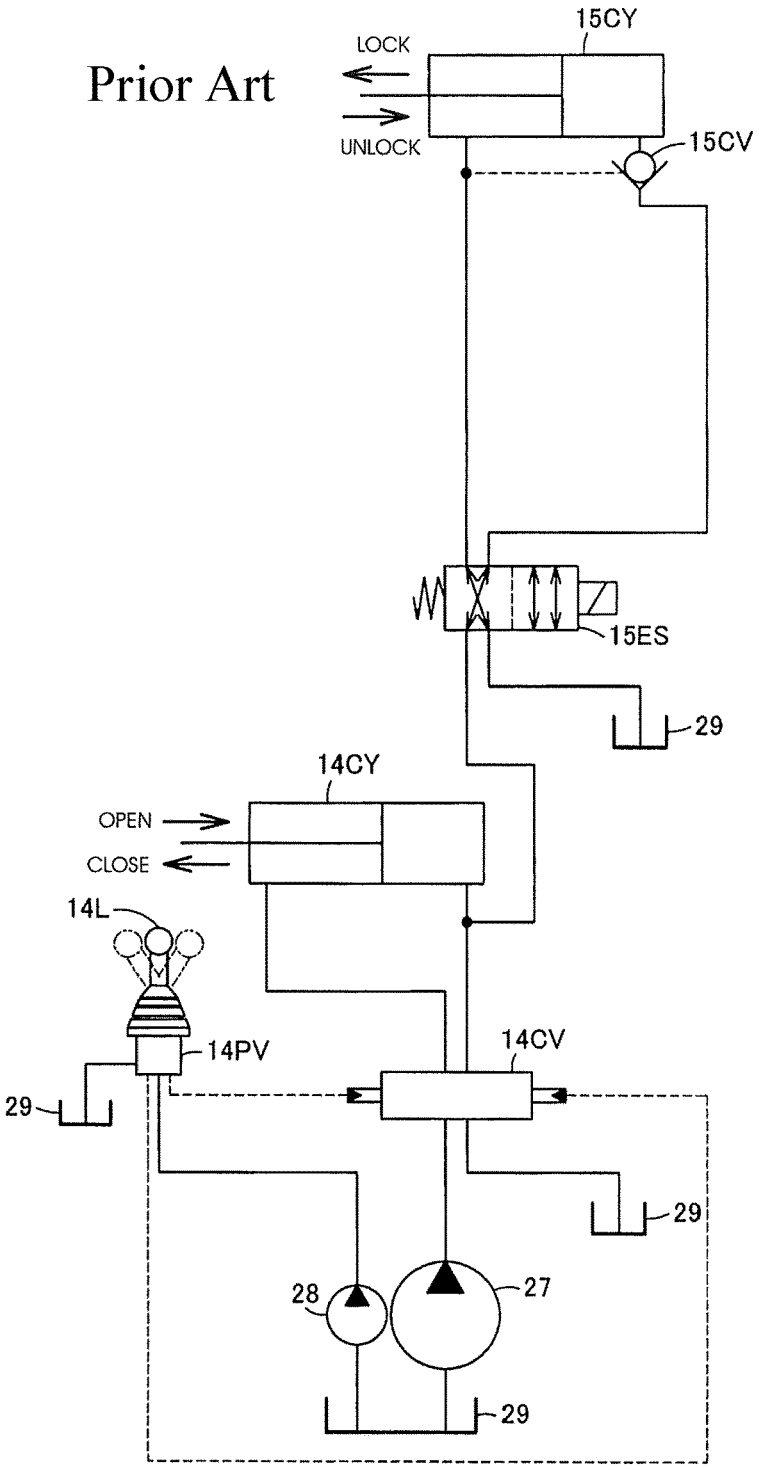
FIG. 8 is a circuit diagram depicting a conventional quick coupler control circuit.

The present invention will be described below in detail with reference to one embodiment shown in FIGS. 1 to 7. FIGS. 5 to 7 have been described in BACKGROUND ART in detail, and only needed description will be given for FIGS. 5 to 7 using reference numerals used in FIGS. 5 to 7. Furthermore, components common to the conventional circuit depicted in FIG. 8 are denoted by the same reference numerals as shown in FIGS. 5 to 7.

As depicted in FIG. 5, a quick coupler 15 on which a bucket 14 serving as a work tool is removably installed is provided at a tip of an arm 17 serving as a working arm of an excavator 11 serving as a working machine. As depicted in FIG. 6, a lock cylinder 15CY is attached to the quick coupler 15. An extending operation of the lock cylinder 15CY allows a movable engagement portion 24 to pivot in a fixing direction, that is, a lock direction. A contracting operation of the lock cylinder 15CY allows the movable engagement portion 24 to pivot in an unfixing direction, that is, an unlock direction.

As depicted in FIG. 7, in the quick coupler 15, a fixing engagement portion 22 is internally engaged with a pin 22*p*, one of a pair of pins 22*p* and 24*p* provided on a bucket 14 positioned on the ground, and a bucket cylinder 14CY serving as a tool cylinder allowing the bucket 14 to pivot is allowed to perform an extending operation. Thus, the quick coupler 15 is pivoted clockwise around the pin 22*p* to interpose a movable engagement portion 24 inside the other pin 24*p*. Then, the lock cylinder 15CY performs an extending operation to engage the movable engagement portion 24 with a lower side of the pin 24*p* to lock a bucket coupling state.

Figure 1:
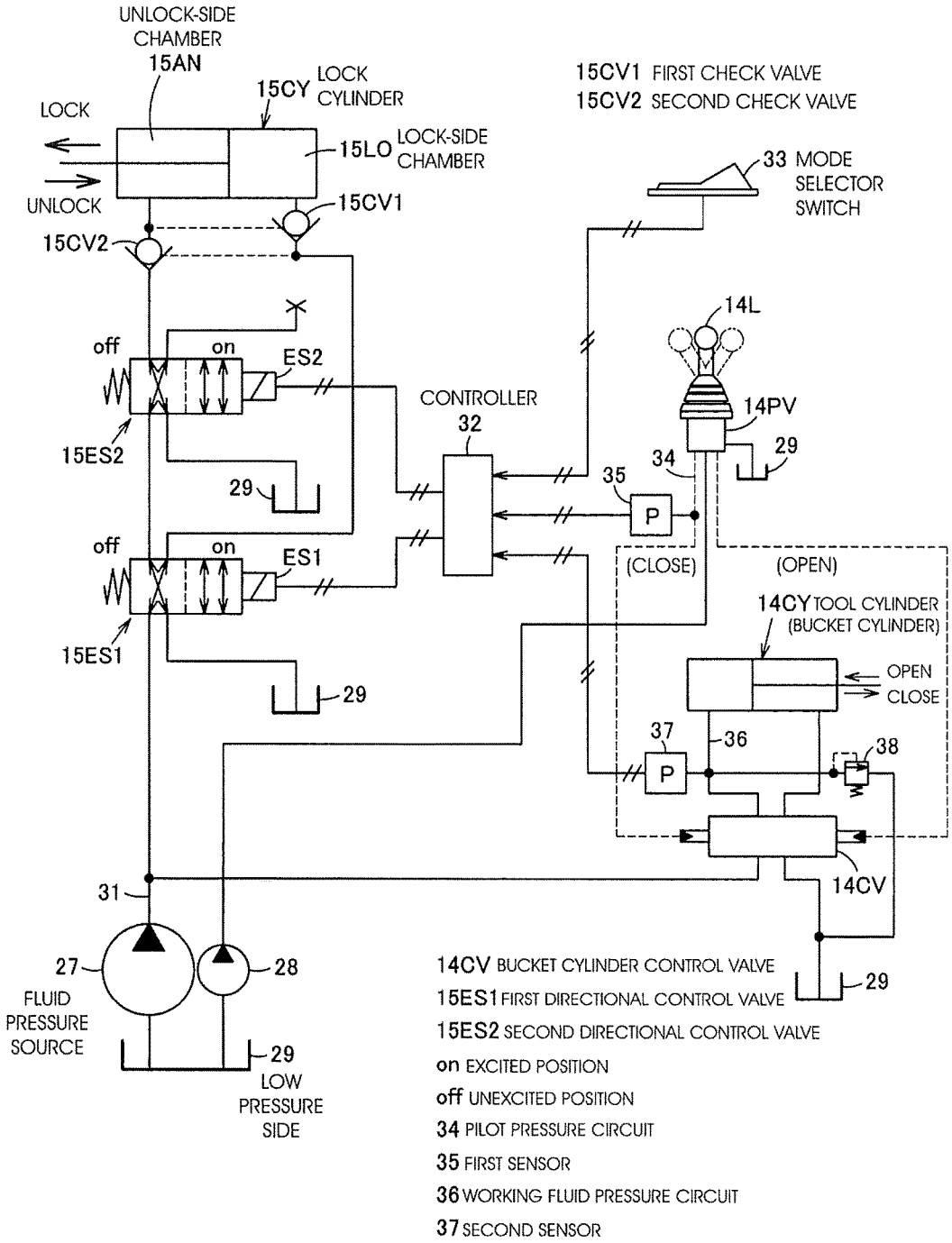
FIG. 1 is a circuit diagram depicting an embodiment of a quick coupler control device for a working machine according to the present invention.

As depicted in FIG. 1, the lock cylinder 15CY has a lock-side chamber 15LO that is pressurized when the bucket 14 installed on the quick coupler 15 is actuated in a lock direction in which the bucket 14 is fixed and an unlock-side chamber 15AN that is pressurized when the bucket 14 is actuated in an unlock direction in which the bucket 14 is unfixed.

A main pump 27 serving as a fluid pressure source is driven by an in-vehicle engine (not depicted in the drawings) mounted on a machine body 12 of the excavator 11 and driven along with a pilot pump 28 that supplies pilot primary pressure to a pilot circuit under pressure. The main pump 27 pumps up hydraulic oil which is stored in a tank 29 serving as a low pressure side of the fluid pressure source and which serves as a working fluid, and feeds the hydraulic oil to a hydraulic circuit under pressure.

A solenoid-operated first direction control valve 15ES1 is connected to a discharge passage 31 for the main pump 27. The first direction control valve 15ES1 has an unexcited position off where the hydraulic oil fed under pressure from the main pump 27 to the lock-side chamber 15LO of the lock cylinder 15CY and an excited position on where the hydraulic oil fed under pressure from the main pump 27 to the unlock-side chamber 15AN of the lock cylinder 15CY and where return oil discharged from the lock-side chamber 15LO is discharged to the tank 29.

A pilot-operated first check valve 15CV1 is provided which sets a forward direction in which hydraulic oil is fed under pressure from the first direction control valve 15ES1 to the lock-side chamber 15LO of the lock cylinder 15CY. A check function of the first check valve 15CV1 is cancelled using hydraulic oil pressure supplied under pressure to the unlock-side chamber 15AN of the lock cylinder 15CY, as a pilot pressure.

A pilot-operated second check valve 15CV2 is provided which sets a forward direction in which hydraulic oil is fed under pressure to the unlock-side chamber 15AN of the lock cylinder 15CY. A check function of the second check valve 15CV2 is cancelled using hydraulic oil pressure supplied under pressure to the lock-side chamber 15LO of the lock cylinder 15CY, as a pilot pressure.

A solenoid-operated second direction control valve 15ES2 is provided between the first direction control valve 15ES1 and the second check valve 15CV2. The second direction control valve 15ES2 has an unexcited position off where return oil flowing out from the unlock-side chamber 15AN of the lock cylinder 15CY via the second check valve 15CV2 is discharged to the tank 29 and where hydraulic oil fed via the first direction control valve 15ES1 is blocked and an excited position on where hydraulic oil fed via the first direction control valve 15ES1 is guided to the unlock-side chamber 15AN of the lock cylinder 15CY.

A solenoid coil ES1 for the first direction control valve 15ES1 and a solenoid coil ES2 for the second direction control valve 15ES2 are connected to an output side of a controller 32.

The controller 32 connects, at an input side thereof, to a mode selector switch 33 that switches between a lock mode where the lock cylinder 15CY is actuated in the lock direction and an unlock mode where the lock cylinder 15CY is actuated in the unlock direction, a first sensor 35 provided in a pilot pressure circuit 34 that operates a bucket cylinder control valve 14CV in a bucket close direction, and a second sensor 37 provided in a hydraulic oil pressure circuit 36 serving as a working fluid pressure circuit that operates the bucket cylinder 14CY in the bucket close direction, the second sensor 37 detecting a bucket operating pressure.

When an operation lever 14L for a pilot-operated valve 14PV is operated from a neutral position to a bucket close side, a pilot pressure output from the pilot-operated valve 14PV operates the bucket cylinder control valve 14CV in the bucket close direction to actuate the bucket cylinder 14CY in the bucket close direction. Thus, the first sensor 35, which is a pressure sensor, is provided to detect a state of operation in the bucket close direction or a state of no operation.

The second sensor 37 is a pressure sensor that detects a head pressure acting on a head side of the bucket cylinder 14CY to detect a loaded state where load is applied the head side or a unloaded state where no load is applied to the head side. When the bucket 14 performs a close operation in an open area, the weight of the bucket acts downward to impose no load on the head side of the bucket cylinder 14CY. However, when the bucket 14 enters a close area, bucket is forced to perform a close operation against the bucket weight. Thus, the load is applied to the head side of the bucket cylinder 14CY.

A hydraulic oil pressure circuit 36 for the bucket cylinder 14CY is provided with a relief valve 38 that controls a circuit pressure on the hydraulic oil pressure circuit 36. When the circuit pressure on the hydraulic oil pressure circuit 36 is to exceed a relief set pressure, the relief valve 38 is set to a relief produced state where the hydraulic oil in the hydraulic oil pressure circuit 36 is allowed to escape to the tank 29 to maintain the relief set pressure.

The controller 32 uses an AND circuit and the like to arithmetically process signal received from the mode selector switch 33, the first sensor 35, and the second sensor 37. The controller 32 has a function to control both the first direction control valve 15ES1 and the second direction control valve 15ES2 to the unexcited position off when the mode selector switch 33 is in a lock mode, as depicted in Table 1 (a) below, and to control the controller 32 controls both the first direction control valve 15ES1 and the second direction control valve 15ES2 to the excited position on when the mode selector switch 33 is in an unlock mode and the first sensor 35 and the second sensor 37 detect the operation state in the bucket close direction and the loaded state, that is, the relief produced state in the bucket close direction, respectively, as depicted in Table 1 (c) below, and to control the first direction control valve 15ES1 to the excited position on, while controlling the second direction control valve 15ES2 to the unexcited position off, when the mode selector switch 33 is in the unlock mode and the first sensor 35 detects the state of no operation in the bucket close direction, that is, no bucket close state or the second sensor 37 detects the unloaded state in the bucket close direction, that is, a no relief state, as depicted in Table 1 (b) below.

TABLE 1

| | lock mode/unlock mode | ES1 | ES2 |
|---|---|---|---|
| (a) | lock mode | unexcited | unexcited |
| (b) | unlock mode (no bucket close or no relief detected) | excited | unexcited |
| (c) | unlock mode (bucket close and relief detected) | excited | excited |

Figure 2:
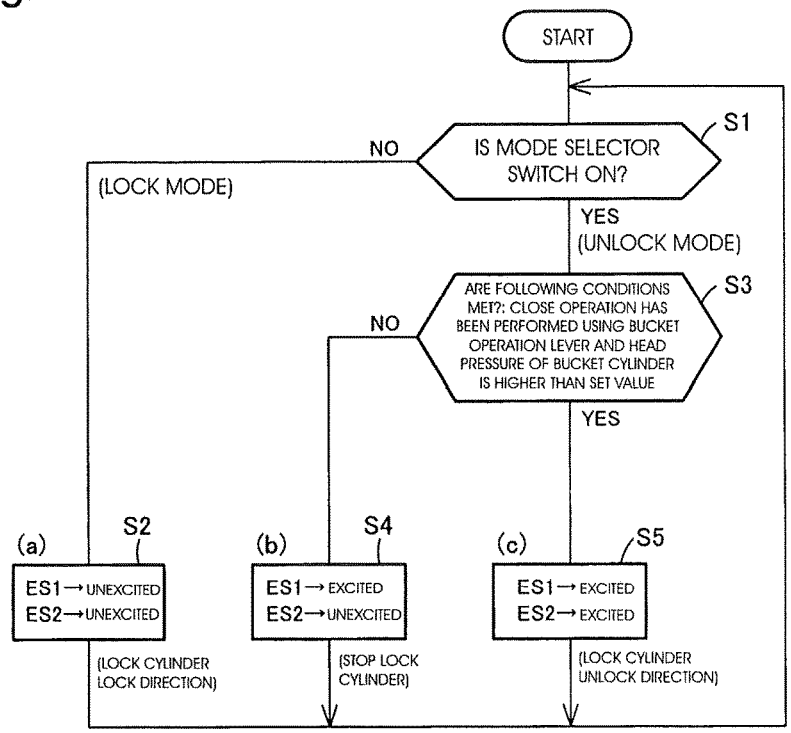
FIG. 2 is a flowchart depicting control logic for the control device.

Now, control logic incorporated in the controller will be described based on a flowchart in FIG. 2.

(Step S1)

The control logic determines whether the mode selector switch 33 is on or off.

(Step S2)

Figure 3:
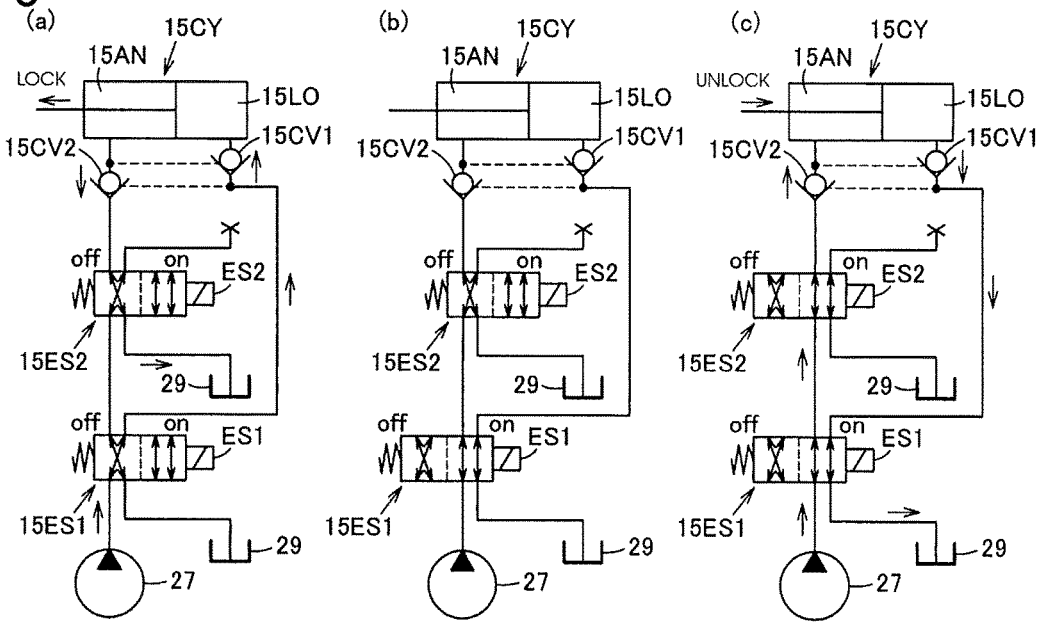
FIG. 3 is a circuit diagram depicting a main circuit portion of the control device, in which FIG. 3(*a*) depicts a circuit state indicative of a lock mode, FIG. 3(*b*) depicts a circuit state which is in an unlock mode and in which a bucket close operation is not performed, that is, a bucket cylinder does not perform a close operation or in which no relief is produced at the time of the close operation, and FIG. 3(*c*) depicts a circuit state which is in an unlock mode and in which relief is produced when the bucket cylinder performs a close operation.

When the mode selector switch 33 is off, the machine is in the lock mode for a normal operation. Thus, the solenoid coils ES1 and ES2 for the first direction control valve 15ES1 and the second direction control valve 15ES2 are both set to an unexcited state to place the first direction control valve 15ES1 and the second direction control valve 15ES2 in the unexcited position off. Then, the lock cylinder 15CY of the quick coupler 15 operates in the lock direction as depicted in FIG. 3(*a*).

(Step S3)

When the mode selector switch 33 is on, the machine is in the unlock mode where the quick coupler 15 is unlocked. Depending on whether or not a pilot pressure in the bucket close direction is detected by the first sensor 35, it is possible to determine whether or not the operation lever 14L for the bucket cylinder 14CY has been operated in the bucket close direction and whether or not a head pressure of the bucket cylinder 14CY is in a state of high load that can be determined by the second sensor 37 on the basis of a predetermined set pressure close to the relief set pressure set by the relief valve 38. Thus, the control logic determines whether or not the operation lever 14L for the bucket cylinder 14CY has been operated in the bucket close direction and whether or not the head pressure of the bucket cylinder 14CY is higher than the predetermined set pressure.

(Step S4)

When the operation lever 14L for the bucket cylinder 14CY has not been operated in the bucket close direction, that is, when the operation lever 14L has been operated in a bucket open direction, when the operation lever 14L is in a neutral position, and when the head pressure of the bucket cylinder 14CY is not higher than the predetermined set pressure, then the first direction control valve 15ES1 is placed in the excited position on and the second direction control valve 15ES2 is placed in the unexcited position off. Then, as depicted in FIG. 3 (*b*), the lock cylinder 15CY is kept in a stopped state by the first check valve 15CV1 and the second check valve 15CV2.

(Step S5)

When the mode selector switch 33 is in the unlock mode, the operation lever 14L for the bucket cylinder 14CY has been operated in the bucket close direction, and the head pressure of the bucket cylinder 14CY is in the loaded state where the head pressure is higher than the predetermined set pressure (step S3 YES), then this state is determined by the AND circuit and the first direction control valve 15ES1 and the second direction control valve 15ES2 are both placed in the excited position on. Then, as depicted in FIG. 3(*c*), the lock cylinder 15CY operates in the unlock direction. At this time, the bucket 14 is positioned on the close side, and thus, the movable engagement portion 24 of the quick coupler 15 performs a disengagement operation in such a manner as to escape to above the pin 24*p* of the bucket 14 and comes off from the pin 24*p*.

When the quick coupler 15 is uncoupled, the procedure of steps S3 to S5 is executed. When the quick coupler 15 is allowed to perform a coupling operation, a procedure depicted in FIGS. 7(*i*), 7(*ii*), and 7(*iii*) is executed and steps S1 and S2 are additionally carried out.

Now, a lock and unlock action of the quick coupler will be described below in detail based on the circuit diagram in FIG. 3 and the logic in Table 1.

FIG. 3(*a*) corresponds to Table 1 (a) and depicts a circuit state indicative of the lock mode for a bucket operation. The circuit state is in the lock mode where the mode selector switch 33 is off, and thus, the first direction control valve 15ES1 and the second direction control valve 15ES2 are in the unexcited position off. Pressure oil discharged from the main pump 27 is fed to the lock-side chamber 15LO of the lock cylinder 15CY via the first direction control valve 15ES1 and the first check valve 15CV1. Oil in the unlock-side chamber 15AN of the lock cylinder 15CY is discharged via the second check valve 15CV2, the check function of which has been canceled as a result of a pilot operation that uses pressure oil flowing to the lock-side chamber 15LO, and is returned to the tank 29 via the second direction control valve 15ES2. Thus, the rod of the lock cylinder 15CY is pressurized in the lock direction to maintain the lock state of the quick coupler 15 with the bucket 14 installed thereon.

FIG. 3(*b*) corresponds to Table 1 (b) and depicts the unlock mode where the quick coupler 15 is uncoupled. However, in the no bucket close state where the bucket cylinder 14CY is not operated in the close direction or if no relief is produced when the bucket cylinder 14CY performs a close operation, then the bucket 14 may still be positioned in the open area, and the movable engagement portion 24 of the quick coupler 15 faces upward. Thus, even if, in this state, the movable engagement portion 24 of the quick coupler 15 is actuated in the unlock direction by the lock cylinder 15CY, the pin 24*p* of the bucket 14 may fail to come off from the movable engagement portion 24.

Thus, even in the unlock mode, when the bucket cylinder 14CY is not operated in the close direction or when no relief is produced when the bucket cylinder 14CY performs a bucket close operation, the first direction control valve 15ES1 is controlled to the excited position on, and the second direction control valve 15ES2 is controlled to the unexcited position off. Then, pressure oil discharged from the main pump 27 is not fed to the lock cylinder 15CY. The lock-side chamber 15LO of the lock cylinder 15CY is sealed by the first check valve 15CV1. The unlock-side chamber 15AN of the lock cylinder 15CY is sealed by the second check valve 15CV2. Consequently, the lock cylinder 15CY of the quick coupler 15 is not actuated.

Figure 4:
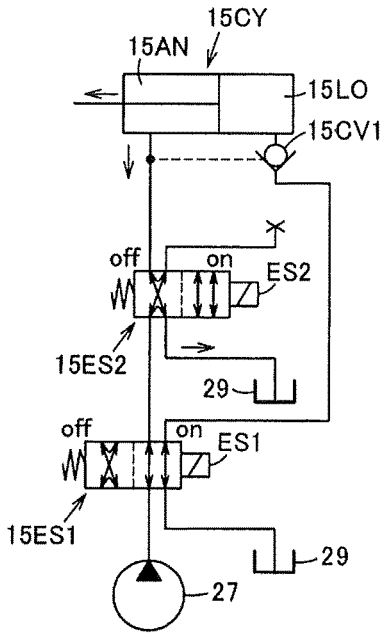
FIG. 4 is a circuit diagram illustrating on condition that no second check valve is provided in the main circuit portion of the control device.

FIG. 4 depicts a circuit, in which the second check valve 15CV2 is missing, in order to clarify the effects of the second check valve 15CV2 in the circuit state depicted in FIG. 3(*b*). The unlock-side chamber 15AN of the lock cylinder 15CY is in communication with the tank 29 via the second direction control valve 15ES2. Thus, the pressure remained in the lock-side chamber 15LO of the lock cylinder 15CY may become higher than the pressure in the unlock-side chamber 15AN. Consequently, even in the no bucket close state where no bucket close operation is performed, for example, when the operation lever 14L for the bucket cylinder 14CY is in the neutral position, the rod of the lock cylinder 15CY extends in the lock direction. The amount of the extension is not large, but this movement is against an operator's intention and may lead to unexpected catching or the like. As a result, even in the unlock mode, the bucket 14 may fail to come off.

To prevent this, the pilot-operated second check valve 15CV2 is added to the unlock-side chamber 15AN of the lock cylinder 15CY as depicted in FIG. 3(*b*). Then, the pressure in the unlock-side chamber 15AN of the lock cylinder 15CY can be prevented from decreasing to prevent unexpected start of movement of the lock cylinder 15CY resulting from the decrease in pressure. Thus, when the operation lever 14L for the bucket cylinder 14CY is returned to the neutral position, the first sensor 35 detects this to provide a signal to allow steps S3 and S4 to be executed. Consequently, the bucket cylinder 14CY can be stopped, and the lock cylinder 15CY can be simultaneously reliably stopped, preventing such movement against the operator's intention as depicted in FIG. 4. That is, the movement of the operation lever 14L for the bucket cylinder 14CY is interlocked with the movement of the lock cylinder 15CY. This allows the lock cylinder 15CY to be also operated using the operation lever 14L for the bucket cylinder 14CY.

Switching the first direction control valve 15ES1 as depicted in FIG. 3(*b*) prevents pressure oil from being fed under pressure to the head side (lock-side chamber 15LO) of the lock cylinder 15CY. This also prevents generation of a check cancelling pilot pressure acting on the second check valve 15CV2, allowing the second check valve 15CV2 to reliably exert a check effect.

FIG. 3(*c*) corresponds to Table 1 (c) and depicts the unlock mode where the mode selector switch 33 is on. A close operation has been performed using the operation lever 14L for the bucket cylinder 14CY, and a load is imposed on the bucket close operation of the bucket cylinder 14CY, leading to a relief-produced circuit state. When the bucket 14 moves from the open area into the close area, the head-side pressure of the bucket cylinder 14CY rises to establish a relief-produced circuit state where the relief valve 38 is actuated.

In the circuit state depicted in FIG. 3(*c*), the first direction control valve 15ES1 and the second direction control valve 15ES2 are controlled to the excited position on. Thus, pressure oil discharged from the main pump 27 is fed to the unlock-side chamber 15AN of the lock cylinder 15CY via the first direction control valve 15ES1, the second direction control valve 15ES2, and the second check valve 15CV2. Furthermore, return oil pushed out from the lock-side chamber 15LO of the lock cylinder 15CY is discharged to the tank 29 via the first check valve 15CV1, the check function of which has been cancelled by a pilot operation that uses pressure oil fed to the unlock-side chamber 15AN, and further via the first direction control valve 15ES1. Consequently, the lock cylinder 15CY operates in the contracting direction to allow the movable engagement portion 24 of the quick coupler 15 to perform an unlock operation in an uncoupling direction. That is, the bucket 14 is in such a closed orientation as depicted in FIG. 5, and thus, the movable engagement portion 24 of the quick coupler 15 can be removed in such a manner as to escape to above the pin 24*p* of the bucket 14. The bucket 14 can thus reliably be uncoupled.

As described above, in the present embodiment, the pilot-operated first check valve 15CV1 and second check valve 15CV2 are provided which have mutual check cancelling functions with respect to the lock cylinder 15CY, and the solenoid-operated first direction control valve 15ES1 and second direction control valve 15ES2 are controlled to the excited position on or to the unexcited position off. Thus, using the simple improvement in which the second direction control valve 15ES2 and second check valve 15CV2 having existing inexpensive structures are added to the first check valve 15CV1 and first direction control valve 15ES1 used in conventional circuits, the lock cylinder 15CY can constantly be pressurized into the lock state, ensuring the coupled state of the quick coupler 15, except when the bucket 14 is replaced. Furthermore, the lock cylinder 15CY can be prevented from malfunctioning to cause the lock state, allowing the quick coupler 15 to be smoothly uncoupled, when the bucket 14 is replaced.

Furthermore, the first sensor 35 is provided in the pilot pressure circuit 34 that operates the bucket cylinder control valve 14CV in the bucket close direction, the second sensor 37 is provided in the hydraulic oil pressure circuit 36 that actuates the bucket cylinder 14CY in the bucket close direction, and the controller 32 controls the first direction control valve 15ES1 and the second direction control valve 15ES2 to the excited position when the mode selector switch 33 is in the unlock mode and the first sensor 35 and the second sensor 37 detect the operation state in the bucket close direction and the loaded state in the bucket close direction, respectively, and otherwise controls the first direction control valve 15ES1 and the second direction control valve 15ES2 to the excited position and the unexcited position off, respectively. Thus, when the bucket is replaced, the lock state of the quick coupler 15 can be automatically cancelled after the first sensor 35 and the second sensor 37 detect that the bucket 14 has been placed in the predetermined closed orientation by being actuated in the close direction. The movable engagement portion 24 of the quick coupler 15 can be smoothly removed from the bucket 14 in the predetermined closed orientation to reliably cancel the coupled state of the quick coupler 15. Furthermore, the bucket close operation performed using the operation lever 14L for the bucket cylinder 14CY and the movement of the lock cylinder 15CY can be synchronized with each other so that, when the operation lever 14L is returned to the neutral position to stop the bucket close operation, even the actuated lock cylinder 15CY can be stopped. This enables the quick coupler 15 to be prevented from malfunctioning against the operator's intention, and allows the operation of unlocking the quick coupler 15 to be suspended as needed.

The present invention is applicable not only to excavators but also to a quick coupler in any other working machine such as a loader which performs bucket operations.

INDUSTRIAL APPLICABILITY

The present invention is industrial applicability for operators that manufacture and sell quick coupler control devices for working machines.

EXPLANATION OF REFERENCE NUMERALS

11 Excavator as working machine
14 Bucket as work tool
14CY Bucket cylinder as tool cylinder
14CV Bucket cylinder control valve
15 Quick coupler
15CY Lock cylinder
15LO Lock-side chamber
15AN Unlock-side chamber
15ES1 First direction control valve
15ES2 Second direction control valve
on Excited position
off Unexcited position
15CV1 First check valve
15CV2 Second check valve
17 Arm as a working arm
27 Main pump as a fluid pressure source
29 Tank as low pressure side
32 Controller
33 Mode selector switch
34 Pilot pressure circuit
35 First sensor
36 Working fluid pressure circuit
37 Second sensor

The invention claimed is:

1. A quick coupler control device for a working machine comprising:

a quick coupler that allows a work tool to be removably installed on a working arm of the working machine;

a lock cylinder attached to the quick coupler and having a lock-side chamber that is pressurized when the work tool installed on the quick coupler is actuated in a lock direction in which the work tool is fixed and an unlock-side chamber that is pressurized when the work tool is actuated in an unlock direction in which the work tool is unfixed;

a solenoid-operated first direction control valve having an unexcited position where a working fluid fed under pressure from a fluid pressure source is guided to a lock-side chamber of the lock cylinder and an excited position where the working fluid fed under pressure from the fluid pressure source is guided to an unlock-side chamber of the lock cylinder and where a return fluid discharged from the lock-side chamber is discharged to a low pressure side of the fluid pressure source;

a pilot-operated first check valve that sets a forward direction, in which a working fluid is fed under pressure from the first direction control valve to the lock-side chamber of the lock cylinder, a check function of the pilot-operated first check valve being cancelled by a working fluid fed under pressure to the unlock-side chamber of the lock cylinder;

a pilot-operated second check valve that sets a forward direction, in which a working fluid is fed under pressure to the unlock-side chamber of the lock cylinder, a check function of the pilot-operated second check valve being cancelled by a working fluid fed under pressure to the lock-side chamber of the lock cylinder;

a solenoid-operated second direction control valve having an unexcited position where a return fluid flowing out from the unlock-side chamber of the lock cylinder via the second check valve is discharged to the low pressure side of the fluid pressure source and where a working fluid fed via the first direction control valve is blocked and an excited position where a working fluid fed via the first direction control valve is guided to the unlock-side chamber of the lock cylinder;

a tool cylinder that pivots the work tool that is removably installed on the working arm of the working machine via the quick coupler;

a mode selector switch that switches between a lock mode where the lock cylinder is actuated in the lock direction and an unlock mode where the lock cylinder is actuated in the unlock direction;

a first sensor that detects whether a state of operation where the tool cylinder is actuated in a predetermined direction is established or whether a state of no operation where the tool cylinder is not actuated in the predetermined direction is established;

a second sensor that detects whether a loaded state where load is applied to the tool cylinder is established and a unloaded state where load is not applied to the tool cylinder is established; and a controller having a function to control the first direction control valve and the second direction control valve to the unexcited position when the mode selector switch is in the lock mode and to control the first direction control valve and the second direction control valve to the excited position when the mode selector switch is in the unlock mode and the first sensor and the second sensor detect the operation state and the loaded state, respectively, and otherwise to control the first direction control valve and the second direction control valve to the excited position and the unexcited position, respectively.

2. The quick coupler control device for a working machine according to claim 1, wherein the tool cylinder is a bucket cylinder that pivots a bucket serving as a work tool removably installed by means of the quick coupler on an arm of an excavator serving as a working machine, the first sensor is provided in a pilot pressure circuit that operates a bucket cylinder control valve in a bucket close direction, the bucket cylinder control valve controlling the bucket cylinder, the second sensor is provided in a working fluid pressure circuit that actuates the bucket cylinder in the bucket close direction, and the controller has a function to control the first direction control valve and the second direction control valve to the excited position when the mode selector switch is in the unlock mode and the first sensor and the second sensor detect the operation state in the bucket close direction and the loaded state in the bucket close direction, respectively, and otherwise to control the first direction control valve and the second direction control valve to the excited position and the unexcited position, respectively.

3. A working machine comprising:

a working arm, and the quick coupler control device of claim 1.

* * * * *